United States Patent [19]

Angioletti

[11] 4,415,616

[45] Nov. 15, 1983

[54] SLAB FOR FLOORING

[75] Inventor: Attilio Angioletti, Milan, Italy

[73] Assignee: Industrie Pirelli S.p.A., Milan, Italy

[21] Appl. No.: 281,694

[22] Filed: Jul. 8, 1981

[30] Foreign Application Priority Data

Jul. 25, 1980 [IT] Italy ..... 23685 A/80

[51] Int. Cl.[3] ..... B32B 3/14; B32B 5/30

[52] U.S. Cl. ..... 428/48; 52/385; 52/388; 52/389; 52/390; 428/47; 428/58; 428/255; 428/286; 428/326

[58] Field of Search ..... 428/326, 327, 284, 189, 428/286, 47, 48, 52, 58, 255; 156/71, 298, 62.2, 303.1, 304.1; 52/390, 388, 391, 408, 385, 389; 264/271.1

[56] References Cited

U.S. PATENT DOCUMENTS

| | | | |
|---|---|---|---|
| 2,229,742 | 1/1941 | Kauffman | 52/389 |
| 3,209,500 | 10/1965 | Bernett | 428/58 |
| 3,335,048 | 8/1967 | Morain | 52/389 |
| 3,968,290 | 7/1976 | Dees, Jr. et al. | 428/286 |

FOREIGN PATENT DOCUMENTS

| | | | |
|---|---|---|---|
| 1965011 | 7/1971 | Fed. Rep. of Germany | 428/58 |
| 772098 | 4/1955 | United Kingdom . | |
| 995619 | 6/1961 | United Kingdom . | |
| 1048132 | 10/1965 | United Kingdom . | |
| 1277196 | 7/1968 | United Kingdom . | |
| 697670 | 11/1979 | U.S.S.R. | 52/389 |

*Primary Examiner*—Paul J. Thibodeau

*Attorney, Agent, or Firm*—Stevens, Davis, Miller & Mosher

[57] ABSTRACT

A slab or block for making a floor comprises a plurality of tiles placed side by side and bonded face to face to a plate of plastic material. Heat insulating shavings such as vulcanized elastomer or wood shavings are dispersed in the plastic matrix of the plate. A textile backing such as a woven textile scrim or net is bonded to the second face of the plate.

11 Claims, 2 Drawing Figures

SLAB FOR FLOORING

This invention relates to a slab or block for making a floor of a building or the like and, more particularly, to a slab for making a floor constituted by a plate having in its surface which will be exposed as the standing surface, a plurality of tiles of conventional type used in the formation of floors such as, for example, ceramic tile, marble tile, cement or concrete tile, plastic tile and the like.

In laying floors formed by tiles placed side by side there are numerous problems.

A first problem is that known tiles transmit noise in undesirable volume which requires soundproofing of the floor before laying the tiles to form a floor.

A second problem is that a long time is required for laying the tiles with attendant high labor cost.

Attempts have been made to solve the problem of long tile laying times by joining the tiles together with a synthetic plate to form a slab without, however, making the slab of a composition so the slab will have any characteristics other than those of the tiles with which it is made.

These heretofore known blocks even if they at least theoretically solve the problem of reducing the cost of laying the floor, have other drawbacks such as poor adhesion of the tiles to the flooring due to mechanical stresses which arise in the plates during handling and laying, to the stresses which arise, during the settling of the building, in the floor covering which causes the tiles to move and to stresses which arise as the floor is used and in the long run cause movements of the tiles.

An object of the present invention is to solve the above problems with known tiles for floors and to provide a slab for flooring which contributes to the soundproofing and waterproofing of the resulting floor, and on which the tiles are adhered. Another object of the invention is to provide an improved building block for making a floor which not only has improved properties but can be installed at a reduced cost.

Figure 1:
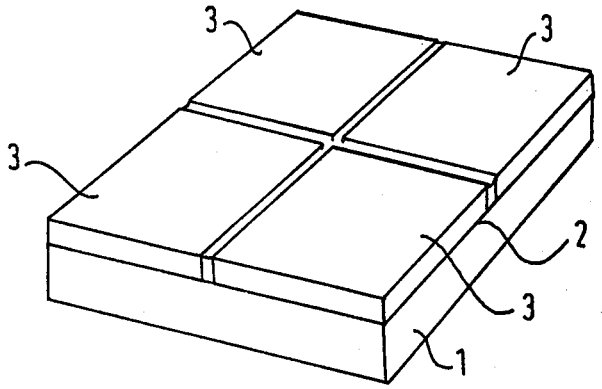
Figure 2:
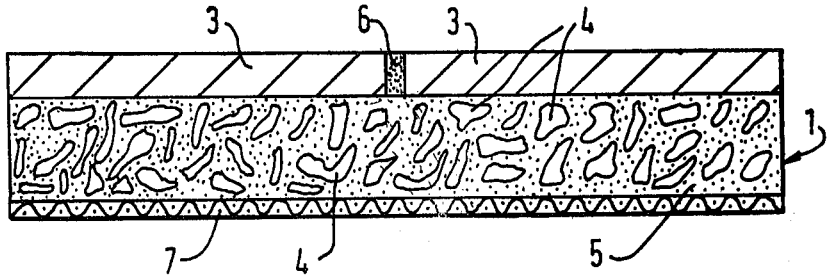

Other objects will become apparent from the following description with reference to the accompanying drawing wherein FIG. 1 is a perspective view of one embodiment of the block provided by the invention for making a floor; and FIG. 2 is a section along the line II—II of FIG. 1.

The foregoing objects and other are accomplished in accordance with this invention, generally speaking, by providing a block or slab for flooring comprising a plurality of tiles bonded to the surface of a plate of synthetic resinous material having a mixture of shavings of sound insulating material dispersed in the synthetic resinous matrix.

In its more general aspects, a slab for flooring according to the present invention comprises a plurality of conventional tiles, or the like, bonded to the surface of a plate of synthetic resinous material having distributed therein shavings of an insulating material and more particularly, shavings of vulcanized elastomeric material or wood shavings embedded in the synthetic resinous plate.

Moreover, also in its more general aspects, the block for making flooring provided by the invention contains means for stiffening the slab such as a fabric scrim or net embedded in the face of the plate which is opposite from the face which is the standing surface.

As shown in FIGS. 1 and 2, one embodiment of a slab for flooring provided by the present invention comprises a plate 1 of synthetic material having bonded to its face 2 a plurality of conventional tiles 3 as, for example ceramic tiles, marble tiles, cement tiles, plastic tiles and the like.

The plate 1 of synthetic material, as is clearly visible in FIG. 2, is formed by a mixture of shavings 4 of vulcanized elastomeric material or of wood shavings embedded in plastic material 5. The plastic material 5 is a substantially non-porous polyurethane resin or polyurethane foam. Microcellular polyurethane foam is preferred. Tiles 3 are disposed on one face of the plate 1 with spaces therebetween. A rib 6 fills the spaces with a substantially non-porous polyurethane.

According to an alternative embodiment of the invention, rib 6 is a plastic material different from that forming the plate 1, is substantially waterproof and is adapted to contact that surface of the slab which, when laid, will constitute the standing surface.

According to a further embodiment of a plate 1 according to the present invention, ribs 6 are not present in spaces between tiles and the edges of adjacent tiles are abutted against each other.

Moreover, as shown in FIG. 2, the faces of plate 1 which is opposite to that on which the tiles 3 are disposed, is covered with a fabric 7. Fabric 7 preferably has the structure of a scrim or net and stiffens the slab against stresses in the slab when it is laid. Such stresses are usually bending stresses which subject the slab to compression stresses in the zone where the tiles are laid and to traction stresses where the slab is in contact with the supporting substrate.

In particular, fabric scrim or net 7 is of a textile material which has a low elongation. The lower the elongation of the material forming the fabric scrim or net 7, the better the bending resistance of the slab.

The slab provided by the invention may be produced in any suitable way, but preferably it is produced in a mold formed by a box-shaped container open on one face, with dimensions equal to the plate to be produced and by a lid or sheet for closing the opening of the box-shaped container.

The tiles are first laid in the box-shaped container with the face which will be exposed when the slab is finished, in contact with the bottom of the box-shaped container.

A mixture of shavings of vulcanized rubber or other elastomer or wood shavings and a foamable plastic material, as, for example, a foamable polyurethane liquid is poured on the tiles housed in the box-shaped container.

The net or fabric is placed on the mixture by bonding it to the upper edge of the box-shaped container that, finally is closed by the closing sheet.

The microcellular polyurethane, foam and non-porous polyurethane elastomer may be made as described by Saunders and Frisch in High Polymers Vol. XVI Polyurethanes: Chemistry and Technology published by Interscience Publishers.

At this point the foaming of the plastic material is initiated, which in the case of polyurethane gives rise to a microcellular polyurethane. This latter causes the adhesion of the tiles to the mass of microcellular polyurethane and the embedding of the fabric or net giving to the slab a monolithic aspect and then the produced slab is removed from the mold.

From the above description it can be understood how the slab for flooring according to the present invention is prepared and the objects of the invention are achieved.

In fact, plates 1 perfectly and firm anchors the tiles to one another and offers very good soundproofing characteristics to the flooring to which the plates are applied.

Moreover, thanks to the high bending rigidity of the slab imparted by the fabric or net 7 placed at a constant distance from the assembly of tiles 3, with consequent formation of a double resistant layer, it is possible to avoid movement of the tiles in the points where poor adhesion of the slab to the bottom may occur or in the event of detachment of the slabs from the substrate due to yieldings of the bottom with settling or undulations of the floor.

Finally, the cost of a floor made with slabs according to the present invention is less that that of a conventional tile floor because of the larger area of the slab which reduces greatly the laying time of the flooring.

Although the invention has been described in detail for the purpose of illustration, it is to be understood that such detail is solely for that purpose and that variations can be made therein by those skilled in the art without departing from the spirit and scope of the invention except as it is limited by the claims.

What is claimed is:

1. A slab for making a flooring, comprising:

a plurality of tiles;

a plate of synthetic resinous material, said resinous material having the form of a matrix, said plate having a first face and a second face, said faces being opposite each other, said plurality of tiles being bonded to said first face;

a sound insulating material dispersed in said matrix of resinous material, said insulating material having the form of shavings; and means for stiffening said slab, said means comprising a reinforcing fabric embedded in the second face of said plate, whereby said slab can be prepared prior to its placement on a floor, thereby reducing the laying time of the flooring.

2. The slab of claim 1 wherein said insulating material comprises wood shavings.

3. The slab of claim 1 wherein said insulating material comprises shavings of a vulcanized elastomeric material.

4. The slab of claim 1 wherein the tiles of said plurality of tiles are placed adjacent to each other with a space therebetween, a polymer material filling the spaces between the tiles so as to form ribs between the tiles, said plurality of tiles and said ribs combining to substantially cover the first face of said plate.

5. The slab of claim 4 wherein said polymer is a polyurethane.

6. The slab of claim 1 wherein said plurality of tiles comprises a plurality of ceramic tiles.

7. The slab of claim 1 wherein said fabric has the form of a net.

8. The slab of claim 7 wherein said net of fabric comprises a textile material having a low elongation coefficient.

9. The slab of claim 1 wherein said plurality of tiles, said plate, and said fabric comprise a monolithic product.

10. The slab of claim 9 wherein said monolithic product is formed in a mold.

11. A molded slab comprising:

a plurality of tiles;

a plate comprising a mixture of shavings of a sound insulating material dispersed in a synthetic resinous matrix, said plate having a first face and a second face, said faces being opposite each other, said plurality of tiles being bonded to the first face of said plate;

means for stiffening said slab, said means comprising a reinforcing fabric embedded in the second face of said plate, whereby said slab can be prepared before being laid on a floor, thereby reducing the time required for laying a flooring.

* * * * *